US009556405B2

(12) United States Patent
Jarvis et al.

(10) Patent No.: US 9,556,405 B2
(45) Date of Patent: Jan. 31, 2017

(54) POLYMER STRUCTURED AQUEOUS DETERGENT COMPOSITIONS

(71) Applicant: Conopco, Inc., Englewood Cliffs, NJ (US)

(72) Inventors: Adam Peter Jarvis, Bebington (GB); Adam John Limer, Bebington (GB); Philip Michael Ryan, Bebington (GB); Matthew Rhys Thomas, Bebington (GB)

(73) Assignee: CONOPCO, INC., Englewood Cliffs, NJ (US)

( * ) Notice: Subject to any disclaimer, the term of this patent is extended or adjusted under 35 U.S.C. 154(b) by 0 days.

(21) Appl. No.: 14/647,674

(22) PCT Filed: Nov. 15, 2013

(86) PCT No.: PCT/EP2013/073935
§ 371 (c)(1),
(2) Date: May 27, 2015

(87) PCT Pub. No.: WO2014/082874
PCT Pub. Date: Jun. 5, 2014

(65) Prior Publication Data

US 2015/0299620 A1 Oct. 22, 2015

(30) Foreign Application Priority Data

Nov. 29, 2012 (WO) ..... PCT/CN2012/085563

(51) Int. Cl.
*C11D 1/02* (2006.01)
*C11D 1/12* (2006.01)
(Continued)

(52) U.S. Cl.
CPC ..... *C11D 3/3765* (2013.01); *C11D 1/02* (2013.01); *C11D 1/22* (2013.01); *C11D 3/3715* (2013.01);
(Continued)

(58) Field of Classification Search
CPC ..... C11D 1/02; C11D 1/12; C11D 1/22; C11D 3/37; C11D 3/3746; C11D 3/505
See application file for complete search history.

(56) References Cited

U.S. PATENT DOCUMENTS 3,341,466 A 9/1967 Brynko et al.
3,577,515 A 5/1971 Vandegaer
(Continued)

FOREIGN PATENT DOCUMENTS

CN 1165576 9/2004
CN 1592604 3/2005
(Continued)

OTHER PUBLICATIONS

Search Report in EP13152035, Jun. 17, 2013.
(Continued)

*Primary Examiner* — Brian P Mruk
(74) *Attorney, Agent, or Firm* — Foley & Lardner LLP

(57) ABSTRACT

An aqueous polymer structured detergent liquid composition comprising: (i) a surfactant system comprising surfactant and alkaline material present as surfactant salts and/or as free base, (ii) optionally, 0.01 wt % or more suspended particles, (iii) optionally, 3 wt % or more polymer that reduces the composition viscosity at 20 $s^{-1}$, and (iv) at least 0.05 wt % of a suspending system comprising copolymer formed by the addition polymerization of: (A) 0.1 to 5 wt % of a first monomer consisting of an ethylenically unsaturated diacid of formula (I): HOOC—$CR_1$=$CR_2$—COOH or an
(Continued)

unsaturated cyclic anhydride precursor of such an ethylenically unsaturated diacid, the anhydride having formula (II) where $R_1$ and $R_2$ are individually selected from H, $C_1$-$C_3$ alkyl, phenyl, chlorine and bromine; (B) 15 to 60 wt % of a second ethylenically unsaturated monoacidic monomer consisting of (meth)acrylic acid; (C) 30 to 70 wt % of a third ethylenically unsaturated monomer consisting of $C_1$-$C_8$ alkyl ester of (meth)acrylic acid; (D) 1 to 25 wt %, of a fourth ethylenically unsaturated monomer, consisting of surfmer of formula (III) wherein each $R_3$ and $R_4$ are each independently selected from H, methyl, —C(═O)OH, or —C(═O)$OR_5$; $R_5$ is a $C_1$-$C_{30}$ alkyl; T is —CH2C(═O)O—, —C(═O)O—, —O—, —$CH_2$O—, —NHC(═O)NH—, —C(═O)NH—, —Ar—$(CE_2)_2$-NHC(═O)O—, —Ar—$(CE_2)_2$-NHC(═O)NH—, or —$CH_2CH_2$NHC(═O)—; Ar is divalent aryl; E is H or methyl; z is 0 or 1; k is an integer in the range of 0 to 30; and m is 0 or 1; with the proviso that when k is 0, m is 0, and when k is in the range of 1 to 30; m is 1; $(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(═O)—, —C(═O)NH—, ═$R_6$NHC(═O)NH—, or —C(═O)NHC(═O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen; and (E) 0.005 to 5 wt %, of a cross linking agent, for introducing branching and controlling molecular weight, the cross linking monomer comprising polyfunctional units carrying multiple reactive functionalization groups selected from the group consisting of vinyl, allyl and functional mixtures thereof.

(II)

(III)

27 Claims, 3 Drawing Sheets

(51) Int. Cl.

| | |
|---|---|
| ***C11D 1/22*** | (2006.01) |
| ***C11D 3/37*** | (2006.01) |
| ***C11D 3/50*** | (2006.01) |
| ***C11D 17/00*** | (2006.01) |

(52) U.S. Cl.
CPC ..... *C11D 3/3723* (2013.01); *C11D 3/505* (2013.01); *C11D 17/0013* (2013.01)

(56) References Cited

U.S. PATENT DOCUMENTS

| | | | | |
|---|---|---|---|---|
| 4,384,096 | A | 5/1983 | Sonnabend | |
| 4,892,916 | A | 1/1990 | Hawe | |
| 5,015,711 | A | 5/1991 | Simonet et al. | |
| 5,057,241 | A | 10/1991 | Merritt et al. | |
| 5,066,419 | A | 11/1991 | Walley et al. | |
| 5,154,842 | A | 10/1992 | Walley et al. | |
| 6,063,857 | A | 5/2000 | Greenblatt et al. | |
| 6,586,107 | B2 | 7/2003 | Klug et al. | |
| 6,797,670 | B2 | 9/2004 | Kleban et al. | |
| 2003/0091523 | A1 | 5/2003 | Dhamdhere | |
| 2003/0125222 | A1 | 7/2003 | Jahns | |
| 2003/0207988 | A1 | 11/2003 | Tamareselvy et al. | |
| 2004/0030034 | A1* | 2/2004 | Chang | C11D 3/3757 524/543 |
| 2004/0063855 | A1 | 4/2004 | Tepe | |
| 2004/0071746 | A1 | 4/2004 | Popplewell et al. | |
| 2004/0142828 | A1 | 7/2004 | Popplewell | |
| 2009/0176676 | A1 | 7/2009 | Hilvert et al. | |

FOREIGN PATENT DOCUMENTS

| | | | |
|---|---|---|---|
| CN | 101076373 | 11/2007 | |
| CN | 102065830 | 5/2011 | |
| EP | 0248612 | 12/1987 | |
| EP | 0385534 | 9/1990 | |
| EP | 0896027 | 2/1999 | |
| EP | 1328616 | 7/2003 | |
| EP | 1402877 | 3/2004 | |
| EP | 1244768 | 8/2004 | |
| EP | 1721915 | 11/2006 | |
| FR | 2920975 | 3/2009 | |
| GB | 751600 | 6/1956 | |
| WO | WO9109109 | 6/1991 | |
| WO | WO9828396 | 7/1998 | |
| WO | WO0238120 | 5/2002 | |
| WO | WO02074430 | 9/2002 | |
| WO | WO03000213 | 1/2003 | |
| WO | WO03088957 | 10/2003 | |
| WO | WO03101606 | 12/2003 | |
| WO | WO2004035015 | 4/2004 | |
| WO | WO2006066654 | 6/2006 | |
| WO | WO2006130675 | 12/2006 | |
| WO | WO2008017620 | 2/2008 | |
| WO | WO2009153184 | 12/2009 | |
| WO | WO2009153281 | 12/2009 | |
| WO | WO2010039145 | 4/2010 | |
| WO | WO2012004132 | 1/2012 | |
| WO | WO2012035053 | 3/2012 | |
| WO | WO2012126786 | 9/2012 | |
| WO | WO 2013/045377 | * 4/2013 | C08F 220/06 |
| WO | WO2013045377 | 4/2013 | |
| WO | WO2014082955 | 6/2014 | |

OTHER PUBLICATIONS

Search Report in PCTEP2013074596, Mar. 3, 2014.
Written Opinion in EP13152035, Jun. 17, 2013.
Written Opinion in PCTEP2013/074596, Mar. 3, 2014.
Co-pending Application: Applicant: Jarvis et al., U.S. Appl. No. 14/647,693, filed May 27, 2015.

* cited by examiner

POLYMER STRUCTURED AQUEOUS DETERGENT COMPOSITIONS

TECHNICAL FIELD

This invention relates to polymer structured aqueous detergent compositions useful for home care applications, including hand dish wash and laundry.

BACKGROUND

In WO09153184, a low dosage or concentrated aqueous laundry detergent liquid is used to reduce the amount of chemicals per wash. This is achieved, without loss of detergency, by reduction of the amount of surfactant used per wash and use, in its place, of highly weight efficient enzymes and polymers to boost detergency on everyday dirt and stains. Preferred compositions use enzymes and combinations of high levels of ethoxylated polyethyleneimine polymer and polyester soil release polymer.

Low dosage compositions formulated this way are suitable for laundry and hard surface cleaning applications. Both the removal of the surfactant and the use of cleaning polymers like ethoxylated polyethylene imine and polyester soil release polymers cause a drop in viscosity of the liquid. We have found that consumers desire that the pour viscosity of a concentrated liquid should be at least as high as a conventional dilute liquid and possibly even higher so that they have a reason to believe that the liquid contains the same cleaning power as a higher dosage detergent liquid with higher surfactant levels and possibly without such high levels of viscosity reducing polymer additives.

It is also desirable to be able to include particulate materials into such liquid detergent compositions, for example encapsulated perfume or visual cues. Advantageously, the liquid should have rheology that provides a yield stress (also known as critical stress) so that the particles remain stably suspended and dispersed and yet the composition may be poured from a bottle or dispensed by a suitable spray or pump mechanism.

Crosslinked hydrophobically modified copolymers are exemplified in US2004 063855 (Rohm and Haas) and where such a polymer was used at 1.5 wt % with a specified clay and 22.3 wt % mixed surfactant. It is stated that the composition synergistically increases the low shear (e.g., suspending or stabilizing) viscosity significantly while having little effect on the mid-shear (pouring) viscosity. We have found that these types of acrylates copolymers give an undesirably high pour viscosity if they are used at a high enough level to provide a suspending rheology. Alternative prior art copolymers do provide the shear thinning behaviour required for suspending but do not on their own provide the pour viscosity that is desired by consumers. This can lead to the need to use a second rheology modifying material in conjunction with the acrylate copolymer. This is an unwanted complication.

It is an object of the present invention to provide detergent compositions with an alternative copolymer that increases the pour viscosity while providing the required rheology for suspending. The increase in pour viscosity is useful to counteract the effect of inclusion of certain polymers that have the effect of reducing the pour viscosity of the composition. The copolymers may be utilised in compositions comprising linear alkyl benzene sulphonate anionic surfactant which is the workhorse surfactant found in most laundry and dish wash compositions.

SUMMARY OF THE INVENTION

According to the present invention there is provided a polymer structured aqueous detergent liquid composition comprising:

(i) a surfactant system comprising surfactant and alkaline material present as surfactant salts and/or as free base, (ii) optionally, at least 0.01 wt % suspended particles, (iii) optionally, at least 3 wt % of a viscosity reducing polymer, and (iv) at least 0.05 wt % of a copolymer formed by the addition polymerisation of:

(A) 0.1 to 5 wt % of a first monomer consisting of an ethylenically unsaturated diacid of formula (I):

$$HOOC—CR_1{=}CR_2—COOH \quad (I)$$

or an unsaturated cyclic anhydride precursor of such an ethylenically unsaturated diacid, the anhydride having formula (II)

(II)

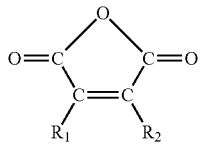

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of $C_1$-$C_8$ alkyl ester of (meth) acrylic acid; and (D) 1 to 25 wt %, of a fourth ethylenically unsaturated monomer, consisting of surfmer of formula (III):

(III)

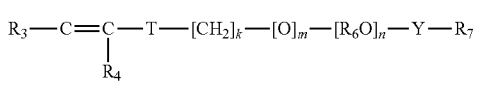

wherein each $R_3$ and $R_4$ are each independently selected from H, methyl, —C(═O)OH, or —C(═O)$OR_5$;

$R_5$ is a $C_1$-$C_{30}$ alkyl;

T is —$CH_2$C(═O)O—, —C(═O)O—, —O—, —$CH_2$O—, —NHC(═O)NH—, —C(═O)NH—, —Ar—$(CE_2)_z$-NHC(═O)O—, —Ar—$(CE_2)_z$-NHC(═O)NH—, or —$CH_2CH_2$NHC(═O)—;

Ar is divalent aryl;

E is H or methyl;

z is 0 or 1;

k is an integer in the range of 0 to 30; and m is 0 or 1; with the proviso that when k is 0, m is 0, and when k is in the range of 1 to 30; m is 1;

$(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(═O)—, —C(═O)NH—, ═$R_6$NHC(═O)NH—, or —C(═O)NHC(═O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen.

Preferably Surfmer D has the formula (IV)

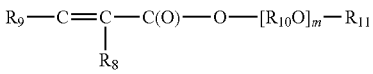

(IV)

where:

$R_8$ and $R_9$ are each independently selected from H, and $C_{1-3}$ alkyl;

$R_{10}$ is $C_2$-$C_4$ and mixtures thereof, preferably $C_2$;

m, the average number of alkoxy units $R_{10}O$, is from 6 to 40;

$R_{11}$ is alkyl or alkylaryl where the alkyl part is linear or branched; and the total number of carbons is from 10 to 40; and (E) 0.005 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof.

In this specification the term (meth)acrylic acid includes both acrylic acid and methacrylic acid and the term (meth) acrylate includes both acrylate and methacrylate.

The viscosity of the liquid at 20 $s^{-1}$ and 25° C. is preferably at least 0.3 Pa·s, most preferably at least 0.4 Pa·s. This viscosity is also known as the pour viscosity of the composition. The compositions preferably have a yield stress of at least 0.1 Pa to facilitate the preferred suspending properties.

The compositions exhibit increased pour viscosities while also having a useful rheology for suspending or spraying. The increase in pour viscosity may be utilised to counteract the effect of inclusion of certain polymers that have the effect of reducing the pour viscosity of the composition.

When used, the suspended particles may comprise microcapsules and a preferred type of microcapsules is perfume encapsulates. Alternatively or additionally the suspended particles may comprise visual cues. The visual cues may be beads or may comprise lamellar particles formed from sheets of polymer film.

The compositions preferably comprise at least 0.1 wt % of the copolymer (iv) and the invention finds particular utility when the polymers added for purposes other than rheology modification have the unwanted side-effect of reducing the pour viscosity of the composition. Noteworthy among these viscosity reducing polymers are ethoxylated polyethylene imine and/or polyester soil release polymer. Preferably polymer (c) comprises at least 3 wt % of ethoxylated polyethylene imine.

Copolymer (iv) preferably has a molecular weight Mw of at least 500 000, more preferably 1 million Daltons.

It is preferred to use maleic anhydride as the first monomer (A) in the copolymerisation.

The copolymers (iv) are crosslinked alkali swellable hydrophobically modified acrylic copolymers, C-HASE. These polymers require alkaline conditions to swell and so should be added to the composition such that they are exposed to appropriate alkaline conditions at some stage during the manufacture of the detergent liquid. It is not essential that the finished liquid composition is alkaline.

Preferably the surfactant system (i) comprises at least 5 wt % total surfactant. More preferably the surfactant system (i) comprises at least 3 wt % of anionic surfactant, most preferably the anionic surfactant comprises linear alkyl benzene sulphonate, which is the workhorse surfactant found in most laundry and hand dish wash compositions. Advantageously for the optimum structuring and suspending the compositions comprise less than 20 wt % surfactant when anionic surfactant is present.

Advantageously the detergent composition comprises an effective amount of at least one enzyme selected from the group comprising, pectate lyase, protease, amylase, cellulase, lipase, mannanase. More advantageously it comprises at least 2 of this group of enzymes even more advantageously at least 3 and most advantageously at least 4 of the enzymes from this group The fourth monomer D is more preferably a surfmer of formula (V).

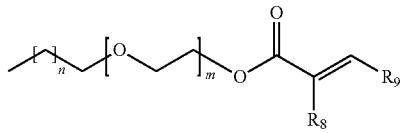

(V)

in which each $R_8$ and $R_9$ are independently selected from H, $C_1$ to $C_3$ alkyl Preferably $R_8$ is a methyl group and $R_9$ is H.

n ranges from 6 to 40 and m ranges from 6 to 40, preferably n ranges from 10 to 30 and m ranges 15 to 35 most preferably n ranges from 12 to 22 and m ranges from 20 to 30. It is preferable that m is greater or equal to n.

Preferably the level of copolymer (iv) in the detergent composition is from 0.05 to 2 wt % of the total composition; more preferably from 0.1 to 1 wt %.

DETAILED DESCRIPTION OF THE INVENTION

Copolymer

The copolymers of the invention are crosslinked addition polymers formed by copolymerisation and crosslinking of four different ethylenically unsaturated monomers and a cross-linker. Throughout this specification the monomer ratios are wt % and are based on the amounts of the monomers used. The monomers will lose their unsaturation as they are polymerised and may become salts when neutralised or swollen. Monomer nomenclature and ratios are all made with reference to the unsaturated, and where appropriate unneutralised, starting monomer materials.

First Monomer A

The copolymer is formed using a monomer A which may ring open to form a diacidic unit in the polymer. Diacidic unit means that carboxylate groups are attached to adjacent carbon atoms in the carbon backbone of the copolymer. Conveniently this unit is formed from a cyclic ethylenically unsaturated anhydride monomer of formula (II). It is preferred that monomer A is such an anhydride.

(II)

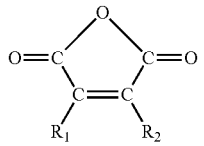

where $R_1$ and $R_2$ are individually selected from H, $C_1$-$C_3$ alkyl, phenyl, chlorine and bromine. Use of a cyclic anhydride monomer with ethylenic unsaturation gives a cis diacid if the ring opens. Such a diacid has both carboxylate groups arranged on the same side of the polymer—but on different carbon atoms.

Preferably $R_1$ is hydrogen and $R_2$ is selected from the group comprising hydrogen, methyl, bromine and phenyl. More preferably $R_1$ is hydrogen and $R_2$ is selected from hydrogen and methyl. Most preferably $R_1$ and $R_2$ are hydrogen so that the anhydride is maleic anhydride. This is the precursor for maleic acid. It is thought that because maleic acid produces carboxylate groups on adjacent carbon atoms in the polymer backbone this increases the localised charge density and causes the difference in performance compared with copolymers not containing this diacid. Itaconic acid which is outside the scope of this invention provides a polymer element where one carbon carries two carboxylate groups and the other carries none. Fumaric acid is the trans isomer of maleic acid it cannot be formed from maleic anhydride monomer by hydrolysis during the emulsion polymerization.

Amounts of Monomer A used for the copolymerisation may range from 0.1 to 5 wt %, preferably from 0.2 to 4 wt %, and more preferably from 0.3 to 1 wt %, and optimally from 0.4 to 0.6 wt % of the total copolymer.

Second Monomer B

The second monomer B is a monoacidic vinyl monomer. Suitable monomers are acrylic acid, methacrylic acid, and combinations thereof.

In the compositions, the acid groups may be neutralized to form salts. Typical salt counterions to the acid groups are sodium, potassium, ammonium and triethanolammonium cations.

Amounts of the monoacidic vinyl monomer in the copolymerisation may range from 15 to 60 wt %, preferably from 20 to 55 wt %, more preferably from 25 to 50 wt % of the total monomers.

Third Monomer C

The third monomer, C, includes one or more $C_1$-$C_8$ esters of acrylic or methacrylic acid. Illustrative ester monomers are ethylacrylate, methylacrylate, ethylmethacrylate, methylmethacrylate, butylacrylate, butylmethacrylate and mixtures thereof. Ethyl acrylate is preferred.

The amount of acrylate ester monomers in the copolymerisation may range from 30 to 70 wt %, preferably from 25 to 60 wt %, and more preferably from 40 to 65 wt % of the total monomers.

Fourth Monomer D

The fourth ethylenically unsaturated monomer, consists of a surfmer of formula (III):

(III)

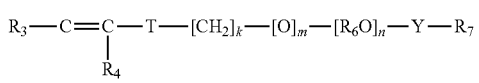

wherein $R_3$ and $R_4$ are each independently selected from H, methyl, —C(═O)OH, or —C(═O)$OR_5$; and $R_5$ is a $C_1$-$C_{30}$ alkyl;

T is —$CH_2$C(═O)O—, —C(═O)O—, —O—, —$CH_2$O—, —NHC(═O)NH—, —C(═O)NH—, —Ar—$(CE_2)_z$-NHC(═O)O—, —Ar—$(CE_2)_z$-NHC(═O)NH—, or —$CH_2CH_2$NHC(═O)—;

Ar is divalent aryl;

E is H or methyl;

z is 0 or 1;

k is an integer in the range of 0 to 30; and m is 0 or 1; with the proviso that when k is 0, m is 0, and when k is in the range of 1 to 30; m is 1;

$(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(═O)—, —C(═O)NH—, ═$R_6$NHC(═O)NH—, or —C(═O)NHC(═O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ group optionally comprises one or more substituents selected from the group consisting of hydroxy, alkoxy, and halogen.

Preferably Surfmer D has the formula (IV)

(IV)

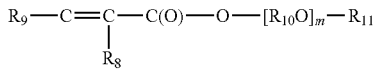

where:

$R_8$ and $R_9$ are each independently selected from H, and $C_{1-3}$ alkyl;

$R_{10}$ is $C_2$-$C_4$ and mixtures thereof, preferably $C_2$;

m, the average number of alkoxy units $R_{10}O$, is from 6 to 40;

$R_{11}$ is alkyl or alkylaryl where the alkyl part is linear or branched; and the total number of carbons is from 10 to 40.

The fourth monomer D is more preferably a surfmer of formula (V).

(V)

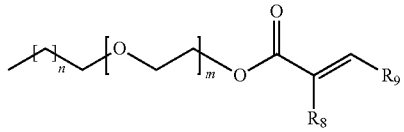

in which each $R_8$ and $R_9$ are independently selected from H, $C_1$ to $C_3$ alkyl Preferably $R_8$ is a methyl group and $R_9$ is H.

n ranges from 6 to 40 and m ranges from 6 to 40, preferably n ranges from 10 to 30 and m ranges 15 to 35 most preferably n ranges from 12 to 22 and m ranges from 20 to 30. It is preferable that m is greater or equal to n.

The amount of surfmer D in the copolymer may range from 1 to 25 wt %, preferably from 3 to 20 wt %, and more preferably from 2 to a 12 wt % of the total copolymer.

Cross Linking Agent E

A crosslinking agent, such as a monomer having two or more ethylenic unsaturated groups, is included with the copolymer components during polymerization. Illustrative examples are divinyl benzene, divinyl naphthalene, trivinyl benzene, triallyl pentaerythritol, diallyl pentaerythritol, diallyl sucrose, octaallyl sucrose, trimethylol propane diallyl ether, 1,6-hexanediol di(meth)acrylate, tetramethylene tri (meth)acrylate, trimethylol propane tri(meth)acrylate, polyethoxylated glycol di(meth)acrylate, alkylene bisacrylamides, bisphenol A polyethyoxylated dimethacrylate, trimethylolpropane polyethoxylated trimethacrylate, ethylene glycol dimethacrylate and butylene glycol dimethacrylate, diallyl phthalate, allyl methacrylate, diacrylobutylene and similar materials. Preferred for the present invention is bisphenol A polyethoxylated glycol diacrylate, diallyl pentaerythritol and trimethylolpropane triacrylate.

Amounts of the cross linking agent used in the copolymerisation may range from 0.005 to 5 wt %, preferably from 0.05 to 3 wt %, more preferably from 1 to 2 wt %, optimally from 0.2 to 1 wt % of the total monomers.

Preferably the level of copolymer in the composition is from 0.05 to 3 wt % of the total composition; more preferably from 0.08 to 2 wt %, even 0.1 to 1 wt % The copolymers may be used with other thickeners to make up the thickening system. Preferred co-thickeners are other thickening polymers and thickening clays.

The copolymer, in aqueous dispersion or in the dry form, may be blended into an aqueous system to be thickened followed, in the case of a pH-responsive thickener, by a suitable addition of acidic or basic material if required. In the case of copolymeric pH-responsive thickeners, the pH of the system to be thickened is at, or is adjusted to, at least 5, preferably at least 6, more preferably at least 7; preferably the pH is adjusted to no more than 12. The neutralizing agent is preferably a base such as an amine base or an alkali metal or ammonium hydroxide, most preferably sodium hydroxide, ammonium hydroxide or triethanolamine (TEA). Alternatively, the copolymer may first be neutralized in aqueous dispersion and then blended.

The molecular weight of the copolymer is typically over 1 million.

The copolymer may be prepared in the presence of a chain transfer agent when a crosslinking agent is used. Examples of suitable chain transfer agents are carbon tetrachloride, bromoform, bromotrichloromethane, and compounds having a mercapto group, e.g., long chain alkyl mercaptans and thioesters such as dodecyl-, octyl-, tetradecyl- or hexadecylmercaptans or butyl-, isooctyl- or dodecyl-thioglycolates. When used, the amount of chain transfer agent is typically from 0.01% to 5%, preferably from 0.1% to 1%, based on weight of the copolymer components. If the crosslinking agent is used in conjunction with a chain transfer agent, which are conflicting operations for polymerization purposes, not only is exceptional efficiency observed but also very high compatibility with hydrophilic surfactants.

The Surfactant System

Surfactants assist in removing soil and also assist in maintaining removed soil in solution or suspension. Anionic or blends of anionic and nonionic surfactants are a preferred feature of the present invention. The amount of anionic surfactant is preferably at least 3 wt %. Alternatively, especially for hand contact applications, such as hand dish wash compositions, alkyl polyglycoside surfactant may be used. In the case that there is no anionic surfactant in the surfactant system there should be alkaline material sufficient to cause the copolymer to swell so that the required shear thinning rheology characteristic of structuring is attained. Suitable alkaline materials are the same ones have been discussed as neutralising agents in relation to the copolymer.

Preferably, anionic surfactant forms the majority of the surfactant system.

Anionic

A preferred type of anionic surfactants is the alkyl sulphonates, particularly alkylbenzene sulphonates, and most particularly linear alkylbenzene sulphonates having an alkyl chain length of $C_8$-$C_{15}$. The counter ion to make the salt of these anionic surfactants is generally an alkali metal, typically sodium, although other counter-ions such as MEA, TEA or ammonium can be used.

Preferred linear alkyl benzene sulphonate surfactants are Detal LAS with an alkyl chain length of from 8 to 15, more preferably 12 to 14.

It is further desirable that the composition comprises an alkyl polyethoxylate sulphate anionic surfactant of the formula (I):

$$RO(C_2H_4O)_xSO_3^-M^+ \quad (I)$$

where R is an alkyl chain having from 10 to 22 carbon atoms, saturated or unsaturated, M is a cation which makes the compound water-soluble, especially an alkali metal, ammonium or substituted ammonium cation, and x averages from 1 to 15.

Preferably R is an alkyl chain having from 12 to 16 carbon atoms, M is Sodium and x averages from 1 to 3, preferably x is 3; This is the anionic surfactant sodium lauryl ether sulphate (SLES). It is the sodium salt of lauryl ether sulphonic acid in which the predominantly C12 lauryl alkyl group has been ethoxylated with an average of 3 moles of ethylene oxide per mole.

Nonionic

Nonionic surfactants include primary and secondary alcohol ethoxylates, especially $C_8$-$C_{20}$ aliphatic alcohol ethoxylated with an average of from 1 to 20 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol. Non-ethoxylated nonionic surfactants include alkyl polyglycosides, glycerol monoethers and polyhydroxy amides (glucamide). Mixtures of nonionic surfactant may be used. When included therein the composition contains from 0.2 wt % to 40 wt %, preferably 1 wt % to 20 wt %, more preferably 5 to 15 wt % of a non-ionic surfactant, such as alcohol ethoxylate, nonylphenol ethoxylate, alkylpolyglycoside, alkyldimethylamineoxide, ethoxylated fatty acid monoethanolamide, fatty acid monoethanolamide, polyhydroxy alkyl fatty acid amide, or N-acyl N-alkyl derivatives of glucosamine ("glucamides").

If used as the sole surfactant, nonionics, in particular alkyl polyglycoside may be structured at levels up to 45 wt % particularly when the composition is maintained at a pH of greater than about 8.5 to ensure adequate swelling of the copolymer.

Nonionic surfactants that may be used include the primary and secondary alcohol ethoxylates, especially the $C_8$-$C_{20}$ aliphatic alcohols ethoxylated with an average of from 1 to 35 moles of ethylene oxide per mole of alcohol, and more especially the $C_{10}$-$C_{15}$ primary and secondary aliphatic alcohols ethoxylated with an average of from 1 to 10 moles of ethylene oxide per mole of alcohol.

Amine Oxide

The composition may comprise up to 10 wt % of an amine oxide of the formula:

$$R^1N(O)(CH_2R^2)_2$$

In which $R^1$ is a long chain moiety each $CH_2R^2$ are short chain moieties. $R^2$ is preferably selected from hydrogen, methyl and —$CH_2OH$. In general $R^1$ is a primary or branched hydrocarbyl moiety which can be saturated or unsaturated, preferably, $R^1$ is a primary alkyl moiety. $R^1$ is a hydrocarbyl moiety having chain length of from about 8 to about 18.

Preferred amine oxides have $R^1$ is $C_8$-$C_{18}$ alkyl, and $R^2$ is H. These amine oxides are illustrated by $C_{12-14}$ alkyldimethyl amine oxide, hexadecyl dimethylamine oxide, octadecylamine oxide.

A preferred amine oxide material is Lauryl dimethylamine oxide, also known as dodecyldimethylamine oxide or DDAO. Such an amine oxide material is commercially available from Huntsman under the trade name Empigen® OB.

Amine oxides suitable for use herein are also available from Akzo Chemie and Ethyl Corp. See McCutcheon's compilation and Kirk-Othmer review article for alternate amine oxide manufacturers.

Whereas in certain of the preferred embodiments $R^2$ is H, it is possible to have $R^2$ slightly larger than H. Specifically, $R^2$ may be $CH_2OH$, such as: hexadecylbis(2-hydroxyethyl) amine oxide, tallowbis(2-hydroxyethyl)amine oxide, stearylbis(2-hydroxyethyl)amine oxide and oleylbis(2-hydroxyethyl)amine oxide.

Preferred amine oxides have the formula:

$$O^-—N^+(Me)_2R^1 \quad (3)$$

where $R^1$ is $C_{12-16}$ alkyl, preferably $C_{12-14}$ alkyl; Me is a methyl group.

Zwitterionic

Nonionic-free systems with up to 95% wt LAS can be made provided that some zwitterionic surfactant, such as carbobetaine, is present. A preferred zwitterionic material is a carbobetaine available from Huntsman under the name Empigen® BB. Betaines and/or amine oxides, improve particulate soil detergency in the compositions of the invention.

Additional Surfactants

Other surfactants may be added to the mixture of detersive surfactants. However cationic surfactants are preferably substantially absent.

Although less preferred, some alkyl sulphate surfactant (PAS) may be used, especially the non-ethoxylated $C_{12-15}$ primary and secondary alkyl sulphates. A particularly preferred material, commercially available from Cognis, is Sulphopon 1214G.

Suspended Particles

The composition has a shear thinning rheology that makes it suitable for suspending particles. Thus preferred compositions comprise suspended particles. These particles are preferably solid; that is to say they are neither liquid nor gas.

However, within the term solid we include particles with either rigid or deformable solid shells which may then contain fluids. For example the solid particles may be microcapsules such as perfume encapsulates, or care additives or other benefit agents in encapsulated form. The particles may be enzymes or other cleaning actives that are insoluble or are encapsulated to prevent or reduce interaction with other composition ingredients. The particles may take the form of insoluble ingredients such as silicones, quaternary ammonium materials, insoluble polymers, insoluble optical brighteners and other known benefit agents as described, for example, in EP1328616. The amount of suspended particles may be from 0.001 to up to 10 or even 20 wt %. One type of solid particle to be suspended is a visual cue, for example the type of flat film cue described in EP13119706. The cue may itself contain a segregated component of the detergent composition. Because the cue must be water-soluble, yet insoluble in the composition, it is conveniently made from a modified polyvinyl alcohol that is insoluble in the presence of the mixed surfactant system. In that case, the detergent composition preferably comprises at least 5 wt % anionic surfactant.

The suspended particles can be any type. This includes perfume encapsulates, care encapsulates and/or visual cues or suspended solid opacifier such as mica or other suspended pearlescent materials and mixtures of these materials. The closer the match of the density of the suspended particles to that of the liquid. Typically, up to 5 wt % of suspended particles may be suspended stably; however, amounts up to 20 wt % are possible.

The benefit agents that may be delivered via suspended particles include any compatible benefit agent which can provide a benefit to a substrate which is treated with a preferably surfactant-containing composition can be used. Advantages of the particles of the invention in the presence of surfactant are a good retention of the benefit agent on storage of a formulation and controllable release of the benefit agent during and after product usage.

Preferred benefit agents are fragrances, profragrance, clays, enzymes, antifoams, fluorescers, bleaching agents and precursors thereof (including photo-bleach), dyes and/or pigments, conditioning agents (for example cationic surfactants including water-insoluble quaternary ammonium materials, fatty alcohols and/or silicones), lubricants (e.g. sugar polyesters), colour and photo-protective agents (including sunscreens), antioxidants, ceramides, reducing agents, sequestrants, colour care additives (including dye fixing agents), unsaturated oil, emollients, moisturisers, insect repellents and/or pheromones, drape modifiers (e.g. polymer latex particles such as PVAc) and anti-microbial and microbe control agents. Mixtures of two or more of these may be employed. Particular benefit agents are described in further detail below.

Benefits include, for laundry applications, benefits of softening, conditioning, lubricating, crease reducing, ease of ironing, moisturising, colour preserving and/or anti-pilling, quick drying, UV protecting, shape retaining, soil releasing, texturising, insect repelling, fungicidal, dyeing and/or fluorescent benefit to the fabric. A highly preferred benefit is the delivery of fragrance (whether free and/or encapsulated), or pro-fragrance or other volatile benefit agent.

Preferred sunscreens are vitamin B3 compounds. Suitable vitamin B3 compounds are selected from niacin, niacinamide, nicotinyl alcohol, or derivatives or salts thereof.

Preferred anti-oxidants include vitamin E, retinol, antioxidants based on hydroxytoluene such as Irganox™ or commercially available antioxidants such as the Trollox™ series.

Perfume is one example of a volatile benefit agent. Typical volatile benefit agents have a molecular weight of from 50 to 500. Where pro-fragrances are used the molecular weight will generally be higher.

Useful components of the perfume include materials of both natural and synthetic origin. They include single compounds and mixtures. Specific examples of such components may be found in the current literature, e.g., in Fenaroli's Handbook of Flavour Ingredients, 1975, CRC Press; Synthetic Food Adjuncts, 1947 by M. B. Jacobs, edited by Van Nostrand; or Perfume and Flavour Chemicals by S. Arctander 1969, Montclair, N.J. (USA). These substances are well known to the person skilled in the art of perfuming, flavouring, and/or aromatizing consumer products, i.e., of imparting an odour and/or a flavour or taste to a consumer product traditionally perfumed or flavoured, or of modifying the odour and/or taste of said consumer product.

By perfume in this context is not only meant a fully formulated product fragrance, but also selected components of that fragrance, particularly those which are prone to loss, such as the so-called 'top notes'. The perfume component could also be in the form of a pro-fragrance. WO 2002/038120 (P&G), for example, relates to photo-labile pro-fragrance conjugates which upon exposure to electromagnetic radiation are capable of releasing a fragrant species.

Top notes are defined by Poucher (Journal of the Society of Cosmetic Chemists 6(2):80 [1955]). Examples of well known top-notes include citrus oils, linalool, linalyl acetate, lavender, dihydromyrcenol, rose oxide and cis-3-hexanol. Top notes typically comprise 15 to 25 wt % of a perfume composition and in those embodiments of the invention which contain an increased level of top-notes it is envisaged at that least 20 wt % would be present within the encapsulate.

Typical perfume components which it is advantageous to encapsulate include those with a relatively low boiling point, preferably those with a boiling point of less than 300, preferably 100 to 250 Celsius.

It is also advantageous to encapsulate perfume components which have a low Log P (i.e. those which will be partitioned into water), preferably with a Log P of less than 3.0.

Another group of perfumes with which the present invention can be applied are the so-called 'aromatherapy' materials. These include many components also used in perfumery, including components of essential oils such as Clary Sage, Eucalyptus, Geranium, Lavender, Mace Extract, Neroli, Nutmeg, Spearmint, Sweet Violet Leaf and Valerian. By means of the present invention these materials can be transferred to textile articles that will be worn or otherwise come into contact with the human body (such as handkerchiefs and bed-linen).

The volatile benefit agents also include insect repellent materials (where insect should be read broadly to include other pests which are arthropods but not strictly hexapods—for example ticks). Many of these materials overlap with the class of perfume components and some are odourless to humans or have a non-perfume odour. Commonly used repellents include: DEET (N,N-diethyl-m-toluamide), essential oil of the lemon eucalyptus (*Corymbia citriodora*) and its active compound p-menthane-3,8-diol (PMD), Icaridin, also known as Picaridin, D-Limonene, Bayrepel, and KBR 3023, Nepetalactone, also known as "catnip oil", Citronella oil, Permethrin, Neem oil and Bog Myrtle. Known insect repellents derived from natural sources include: *Achillea alpina*, alpha-terpinene, Basil oil (*Ocimum basilicum*), *Callicarpa americana* (Beautyberry), Camphor, Carvacrol, Castor oil (*Ricinus communis*), Catnip oil (*Nepeta* species), Cedar oil (*Cedrus atlantica*), Celery extract (*Apium graveolens*), Cinnamon (*Cinnamomum Zeylanicum*, leaf oil), Citronella oil (*Cymbopogon fleusus*), Clove oil (*Eugenic caryophyllata*), Eucalyptus oil (70%+ eucalyptol, also known as cineol), Fennel oil (*Foeniculum vulgare*), Garlic Oil (*Allium sativum*), Geranium oil (also known as *Pelargonium graveolens*), Lavender oil (*Lavandula officinalis*), Lemon eucalyptus (*Corymbia citriodora*) essential oil and its active ingredient p-menthane-3,8-diol (PMD), Lemongrass oil (*Cymbopogon flexuosus*), Marigolds (*Tagetes* species), Marjoram (*Tetranychus urticae* and *Eutetranychus orientalis*), Neem oil (*Azadirachta indica*), Oleic acid, Peppermint (*Mentha×piperita*), Pennyroyal (*Mentha pulegium*), Pyrethrum (from *Chrysanthemum* species, particularly *C. cinerariifolium* and *C. coccineum*), Rosemary oil (*Rosmarinus officinalis*), Spanish Flag Lantana camara (*Helopeltis theivora*), *Solanum villosum* berry juice, Tea tree oil (*Melaleuca alternifolia*) and Thyme (*Thymus* species) and mixtures thereof.

The benefit agent may be encapsulated alone or co-encapsulated with carrier materials, further deposition aids and/or fixatives. Preferred materials to be co-encapsulated in carrier particles with the benefit agent include waxes, paraffins, stabilizers and fixatives.

Silicas, amorphous silicates, crystalline nonlayer silicates, layer silicates, calcium carbonates, calcium/sodium carbonate double salts, sodium carbonates, sodalites, alkali metal phosphates, pectin, carboxyalkylcelluloses, gums, resins, gelatin, gum arabic, porous starches, modified starches, carboxyalkyl starches, cyclodextrins, maltodextrins, synthetic polymers such as polyvinyl pyrrolidone (PVP), polyvinyl alcohol (PVA), cellulose ethers, polystyrene, polyacrylates, polymethacrylates, polyolefins, aminoplast polymers, crosslinkers and mixtures thereof can all provide a basis for benefit agent delivery particles. Polymer particles are however preferred, especially polymer particles which comprise an aminoplast polymer.

Suspension is achieved through providing a yield stress. The yield stress needs to be larger than the stress imposed on the network by the microcapsules or cues otherwise the network is disrupted and the particles can sink or float depending on whether or not they are denser than the base liquid. Perfume microcapsules are almost neutrally buoyant and small, so the required yield stress is low. Air bubbles are bigger and have the biggest density difference and so require a high yield stress (>0.5 Pa, depending on bubble size). If the yield stress is not too high the air bubbles can escape by floating and disengaging from the surface.

Microcapsules preferably comprise a solid shell. Microcapsules carrying an anionic charge should be well dispersed to avoid agglomeration issues. Microcapsules with a cationic charge may also be used. The microcapsule may have a melamine formaldehyde shell. Other suitable shell material may be selected from (poly)urea, (poly)urethane, starch/polysaccharide, xyloglucan and aminoplasts.

Delivery aids may be present at the surface of the particle (microcapsule). These can advantageously be selected from non-ionic materials, preferably cellulose derivatives and polyesters, so give better substantivity to a plurality of substrates. Particularly preferred polysaccharide additional deposition aids include dextran, hydroxy-propyl methyl cellulose, hydroxy-ethyl methyl cellulose, hydroxy-propyl guar, hydroxy-ethyl ethyl cellulose, methyl cellulose, locust bean gum, xyloglucan, guar gum. Particularly preferred polyester additional deposition aids include polymers having one or more nonionic hydrophilic components comprising oxyethylene, polyoxyethylene, oxypropylene or polyoxypropylene segments, and, one or more hydrophobic components comprising terephthalate segments.

The average particle diameter of the microcapsules lies in the range from 1 to 100 micrometer and at least 90 wt % of the microcapsules preferably has a diameter in this range. More preferably, 90 wt % of the microcapsules have a diameter in the range 2 to 50 micrometers, even more preferably 5 to 50 micrometers. Most preferred are microcapsules with diameters less than 30 micrometers. It is advantageous to have a very narrow particle size distribution, for instance 90 wt % of microcapsules in the range 8 to 11 microns. Microcapsules in the range 2 to 5 microns cannot be dispersed so effectively due to the high surface area of the smaller particles.

Preferably the composition comprises at least 0.01 wt % of microcapsules, preferably with an anionic charge. Such microcapsules may deliver a variety of benefit agents by deposition onto substrates such as laundry fabric. To obtain maximum benefit they should be well dispersed through the liquid detergent composition and the vast majority of the microcapsules must not be significantly agglomerated. Any microcapsules that become agglomerated during manufacture of the liquid remain so in the container and will thus be dispensed unevenly during use of the composition. This is highly undesirable. The contents of the microcapsules are normally liquid. For example, fragrances, oils, fabric softening additives and fabric care additives are possible contents. Preferred microcapsules are particles termed core-in-shell microcapsules. As used herein, the term core-in-shell microcapsules refers to encapsulates whereby a shell which is substantially or totally water-insoluble at 40° C. surrounds a core which comprises or consists of a benefit agent (which is either liquid or dispersed in a liquid carrier).

Suitable microcapsules are those described in U.S. Pat. No. 5,066,419 which have a friable coating, preferably an aminoplast polymer. Preferably, the coating is the reaction product of an amine selected from urea and melamine, or mixtures thereof, and an aldehyde selected from formaldehyde, acetaldehyde, glutaraldehyde or mixtures thereof. Preferably, the coating is from 1 to 30 wt % of the particles.

Core-in-shell microcapsules of other kinds are also suitable for use in the present invention. Ways of making such other microcapsules of benefit agents such as perfume include precipitation and deposition of polymers at the interface such as in coacervates, as disclosed in GB-A-751 600, U.S. Pat. No. 3,341,466 and EP-A-385 534, as well as other polymerisation routes such as interfacial condensation, as described in U.S. Pat. No. 3,577,515, US-A-2003/0125222, U.S. Pat. No. 6,020,066 and WO-A-03/101606. Microcapsules having polyurea walls are disclosed in U.S. Pat. No. 6,797,670 and U.S. Pat. No. 6,586,107. Other patent applications specifically relating to use of melamine-formaldehyde core-in-shell microcapsules in aqueous liquids are WO-A-98/28396, WO02/074430, EP-A-1 244 768, US-A-2004/0071746 and US-A-2004/0142828.

Perfume encapsulates are a preferred type of microcapsule suitable for use in the present invention.

A preferred class of core-in-shell perfume microcapsule comprises those disclosed in WO 2006/066654 A1. These comprise a core having from about 5% to about 50 wt % of perfume dispersed in from about 95% to about 50 wt % of a carrier material. This carrier material preferably is a non-polymeric solid fatty alcohol or fatty ester carrier material, or mixtures thereof. Preferably, the esters or alcohols have a molecular weight of from about 100 to about 500 and a melting point from about 37° C. to about 80° C., and are substantially water-insoluble. The core comprising the perfume and the carrier material are coated in a substantially water-insoluble coating on their outer surfaces. Similar microcapsules are disclosed in U.S. Pat. No. 5,154,842 and these are also suitable.

The microcapsules may attach to suitable substrates, e.g. to provide persistent fragrance that is desirably released after the cleaning process is complete.

Liquid Detergent Compositions

The detergent compositions may have a yield stress, also called critical stress, of at least 0.08 Pa, preferably at least 0.09 Pa, more preferably at least 0.1 Pa, even at least 0.15 Pa measured at 25° C. These increasing levels of yield stress are capable of suspending particles of increasingly different density from the bulk liquid. A yield stress of 0.09 Pa has been found sufficient to suspend most types of perfume encapsulates.

The detergent liquid may be formulated as a concentrated detergent liquid for direct application to a substrate, or for application to a substrate following dilution, such as dilution before or during use of the liquid composition by the consumer or in washing apparatus.

Cleaning may be carried out by simply leaving the substrate in contact for a sufficient period of time with a liquid medium constituted by or prepared from the liquid cleaning composition. Preferably, however, the cleaning medium on or containing the substrate is agitated.

Product Form

The liquid detergent compositions are preferably concentrated liquid cleaning compositions. The liquid compositions are pourable liquids.

Throughout this specification, all stated viscosities are those measured at a shear rate of 20 $s^{-1}$ and at a temperature of 25° C. unless stated to be otherwise. This shear rate is the shear rate that is usually exerted on the liquid when poured from a bottle. The liquid detergent compositions according to the invention are shear-thinning liquids.

Optional Ingredients

The cross linked hydrophobically modified copolymer used in the present invention has been found to be compatible with usual ingredients that may be found in detergent liquids. Among which there may be mentioned, by way of example: clays; enzymes, particularly: lipase, cellulase, protease, mannanase, amylase and pectate lyase; cleaning polymers, including ethoxylated polyethylene imines (EPEI) and polyester soil release polymers; chelating agents or sequestrants, including HEDP (1-Hydroxyethylidene-1,1,-diphosphonic acid) which is available, for example, as Dequest® 2010 from Thermphos; detergency builders; hydrotropes; neutralising and pH adjusting agents; optical brighteners; antioxidants and other preservatives, including Proxel®; other active ingredients, processing aids, dyes or pigments, carriers, fragrances, suds suppressors or suds boosters, chelating agents, clay soil removal/anti-redeposition agents, fabric softeners, dye transfer inhibition agents, and transition metal catalyst in a composition substantially devoid of peroxygen species.

These and further possible ingredients for inclusion are further described in WO2009 153184.

Packaging

The compositions may be packaged in any form of container. Their shear thinning properties means that they may be dispensed from a squeezy bottle, from a pump dispenser, from a trigger spray dispenser or by being simply poured from a bottle. The most advantageous form of packing is the type where the product is poured from a bottle, possibly into a measuring cup. The controlled high pour viscosity of the compositions as claimed makes the compositions ideally suited to this mode of dispensing. Typically a plastic bottle with a detachable closure/pouring spout. The bottle may be rigid or deformable. A deformable bottle allows the bottle to be squeezed to aid dispensing. If clear bottles are used they may be formed from PET. Polyethylene or clarified polypropylene may be used. Preferably the container is clear enough that the liquid, with any visual cues therein, is visible from the outside. The bottle may be provided with one or more labels, or with a shrink wrap sleeve which is desirably at least partially transparent, for example 50% of the area of the sleeve is transparent. The adhesive used for any transparent label should not adversely affect the transparency.

The invention will now be further described with reference to the following non-limiting examples and to the drawings of which:

EXAMPLES

Surfmer Synthesis

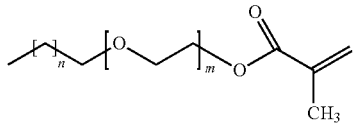

Figure 1:
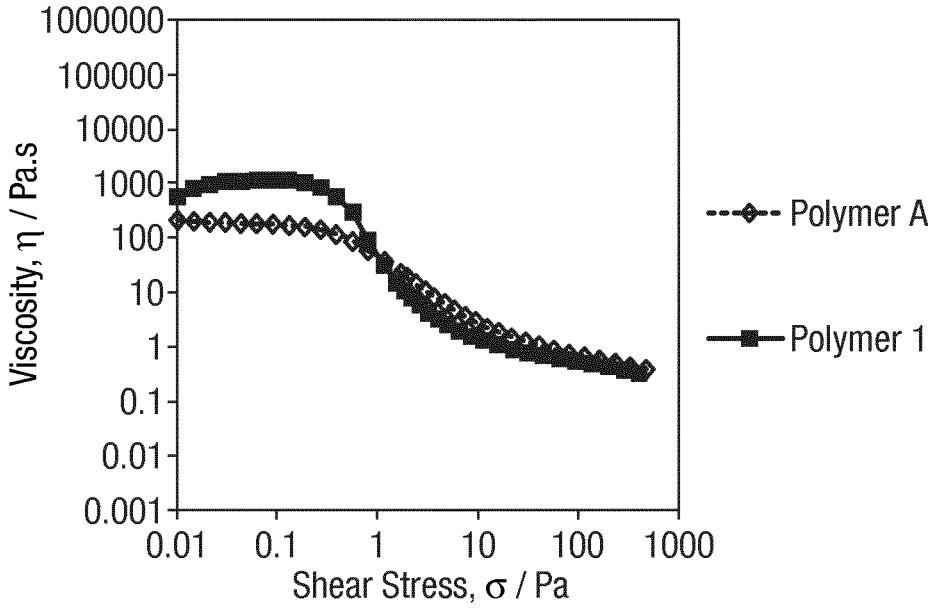
FIGS. 1 and 2 are rheology curves for low surfactant compositions with thinning polymer comparing the high pour viscosities achieved with the copolymers according to the invention that are made with maleic anhydride with similar copolymers made without maleic anhydride.

n = 12
m = 23

Brij® 35P (150 g) Sigma Aldrich was dissolved in 500 ml anhydrous dichloromethane under a nitrogen atmosphere and cooled in an ice bath to 5° C. Triethylamine (18.6 g) was added via syringe before methacryloyl chloride (20.9 g) was added dropwise over a 30 minute period. After complete addition, the solution was allowed to warm to room temperature and the reaction stirred for 4 weeks. The solution was then filtered to remove the resulting precipitate and washed once with saturated sodium hydrogen carbonate solution (200 ml) and once with saturated brine (200 ml). The solution was then passed through a column containing basic alumina before the product was dried with anhydrous magnesium sulphate, filtered and the solvent removed in vacuo. In subsequent examples the product is referred to as Surfmer A.

HASE Copolymer 1 Synthesis

A round bottom flask was charged with ethyl acrylate (EA) (66.19 g), methacrylic acid (MAA)(40.41 g), maleic anhydride (Mal) (0.552 g) trimethylolpropane triacrylate (X-linker) (0.576 g) and Surfmer A (7.36 g). The mixture was sealed and purged with nitrogen for 60 minutes before sodium dodecyl sulfonate (1.03 g) and deoxygenated water (26.5 g) was added and stirred forming a pre-emulsion. A multineck round bottom flask was fitted with a nitrogen sparge and overhead stirrer. Deoxygenated water (181 g) and sodium dodecyl sulfonate (0.298 g) were added, stirred at 250 rpm and heated to 90° C. Ammonium persulfate (0.073 g) in water (1 ml) was added via syringe. The pre-emulsion was fed into the surfactant solution via peristaltic pump over 150 minutes. After complete addition, ammonium persulfate (0.033 g) in water (1 ml) was added and the reaction stirred for a further 240 minutes. The resulting Copolymer 1 and further Copolymer 2 as shown in Table 1 were synthesised by using suitable adaptations of this process and used as described hereafter. Comparative copolymers A and B were synthesised in a similar manner but without the addition of the maleic anhydride.

TABLE 1

| Polymer | MAA | Mal | EA | Surfmer | x-linker |
|---|---|---|---|---|---|
| A | 35.20 | 0.00 | 57.80 | 6.50 | 0.50 |
| 1 | 35.10 | 0.48 | 57.50 | 6.40 | 0.50 |
| B | 34.30 | 0.00 | 56.20 | 9.10 | 0.50 |
| 2 | 34.10 | 0.47 | 55.90 | 9.00 | 0.50 |

The polymers from Table 1 were added to a variety of detergent bases as specified in Table 2 and the viscosity measured using the following method.

Rheology Flow Curve Measurement

Rheology flow curves are generated using the following three step protocol:—

Instrument—Paar Physica—MCR300 with Automatic Sample Changer (ASC)

Geometry—CC27, profiled DIN concentric cylinder

Temperature—25° C.

Step 1—Controlled stress steps from 0.01 to 400 Pa; 40 steps logarithmically spaced in stress with 40 s being spent at each point to measure the shear rate (and hence viscosity); Step 1 is terminated once a shear rate of $0.1^{s-1}$ is reached.

Step 2—Controlled shear rate steps from 0.1 to $1200^{s-1}$; 40 steps logarithmically spaced in shear rate with 6 seconds being spent at each point to determine the stress required to maintain the shear rate and hence the viscosity.

Step 3—Controlled shear rate steps from 1200 to $0.1^{s-1}$; 40 steps logarithmically spaced in shear rate with 6 seconds being spent at each point to determine the stress required to maintain the shear rate and hence the viscosity.

The results of the first two steps are combined being careful to remove any overlap and to ensure that the required shear rates were achieved at the start of the step.

The yield stress in Pa is taken to be the value of the stress at a shear rate of $0.1^{s-1}$. I.e. the equivalent of the y-axis intercept in a Herschel-Buckley plot of shear stress vs. shear rate. The yield stress was taken as the point at which the data cut the viscosity=10 Pa·s and the pour viscosity was taken as the viscosity at $20^{s-1}$, both at 25° C.

In the examples the following materials are used:

LAS acid is C12-14 linear alkylbenzene sulphonic acid.

Fatty acid is saturated lauric fatty acid Prifac® 5908 ex Croda.

SLES 3EO is sodium lauryl ether sulphate with 3 moles EO.

Empigen® BB is an alkyl betaine ex Huntsman (Coco dimethyl carbobetaine), an amphoteric surfactant.

NI 7EO is C12-15 alcohol ethoxylate 7EO nonionic Neodol® 25-7 (ex Shell Chemicals).

MPG is mono propylene glycol.

Alkaline neutraliser is triethanolamine or 47% sodium hydroxide solution.

EPEI is Sokalan HP20—ethoxylated polyethylene imine cleaning polymer: PEI (600) 20EO ex BASF.

SRP is polyester soil release polymer (Texcare SRN170 ex Clariant).

Perfume is free oil perfume.

Demin water is demineralised water

TABLE 2

| wt % | Liquid L1 | Liquid L2 | Liquid L3 | Liquid L4 |
|---|---|---|---|---|
| Total Active detergent % (AD) | 10 | 10 | 10 | 24 |
| SLES | 1.67 | 7.5 | 7.5 | 4.0 |

TABLE 2-continued

| wt % | Liquid L1 | Liquid L2 | Liquid L3 | Liquid L4 |
|---|---|---|---|---|
| LAS | 3.33 | 2.5 | 2.5 | 8.0 |
| NI 7EO | 5.0 | 0 | 0 | 12.0 |
| Amine Oxide | 0 | 0 | 0 | 0 |
| EPEI | 3 | 3 | 0 | 3 |
| Copolymer | 2 | 2 | 2 | 2 |
| pH | 8.0 | 8.0 | 8.0 | 8.0 |

Rheology Testing

Copolymers were tested in Liquid L1. The Rheology curves for pairs of polymers are given:

FIG. 1: Copolymer 1 vs. Copolymer A in L1

Figure 2:
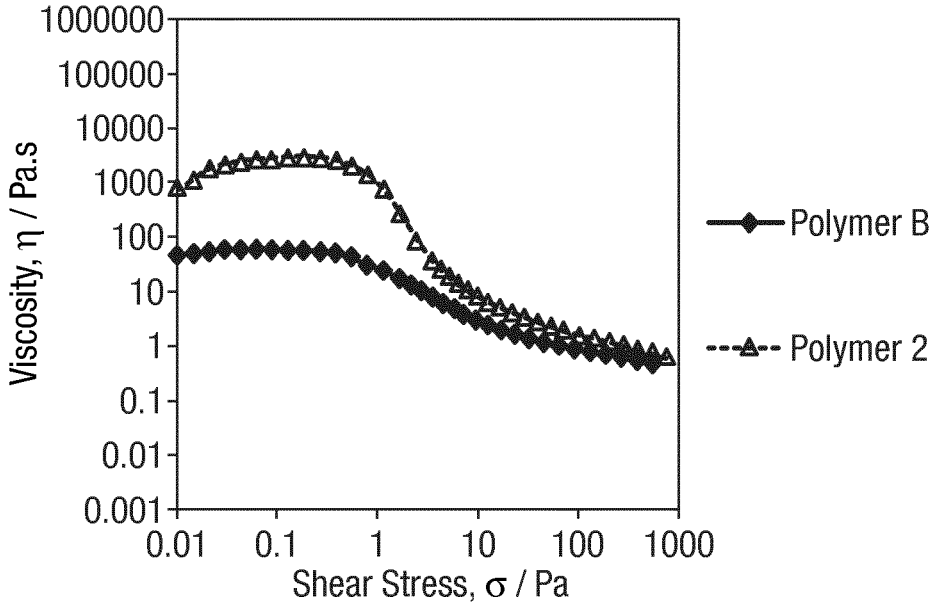

FIG. 2: Copolymer 2 vs. Copolymer B in L1

Copolymer 2 and comparative Copolymer B were tested across a wider range of liquids.

Figure 3:
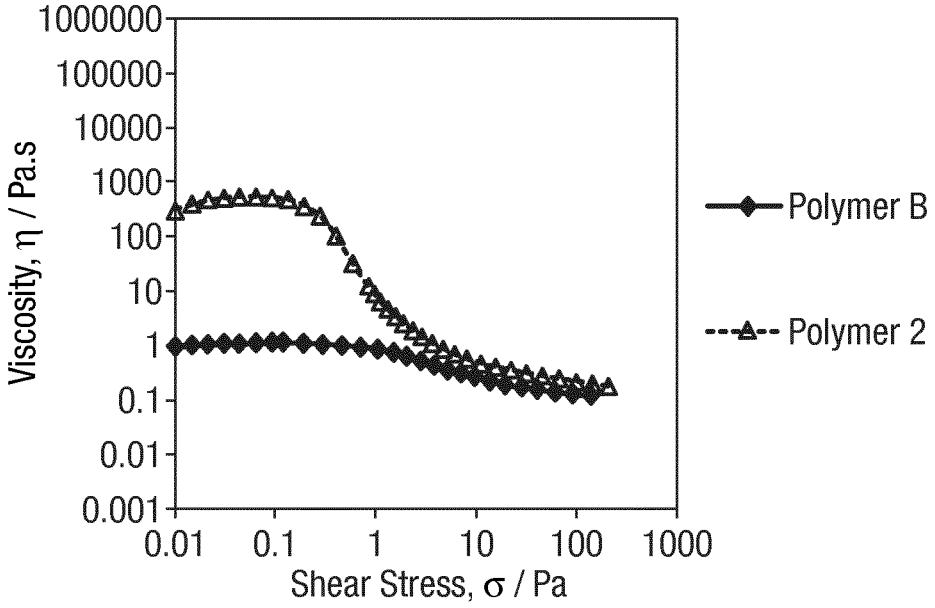
FIG. 3 shows rheology curves for Polymers in another composition with a thinning polymer.

FIG. 3: Copolymer 2 vs. Copolymer B in L2

Figure 4:
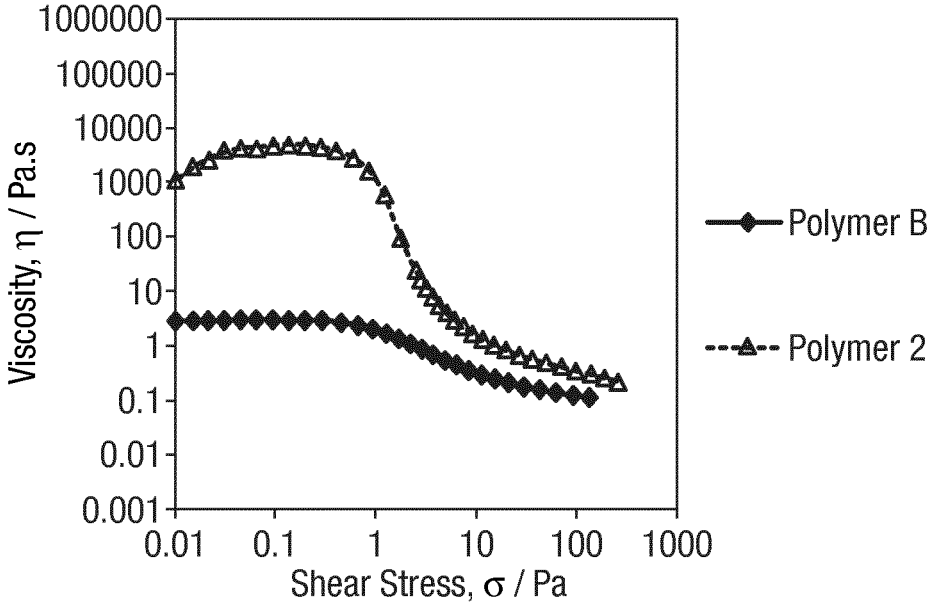
FIG. 4 shows rheology curves for Polymers in a composition without any thinning polymer.

FIG. 4: Copolymer 2 vs. Copolymer B in L3

Figure 5:
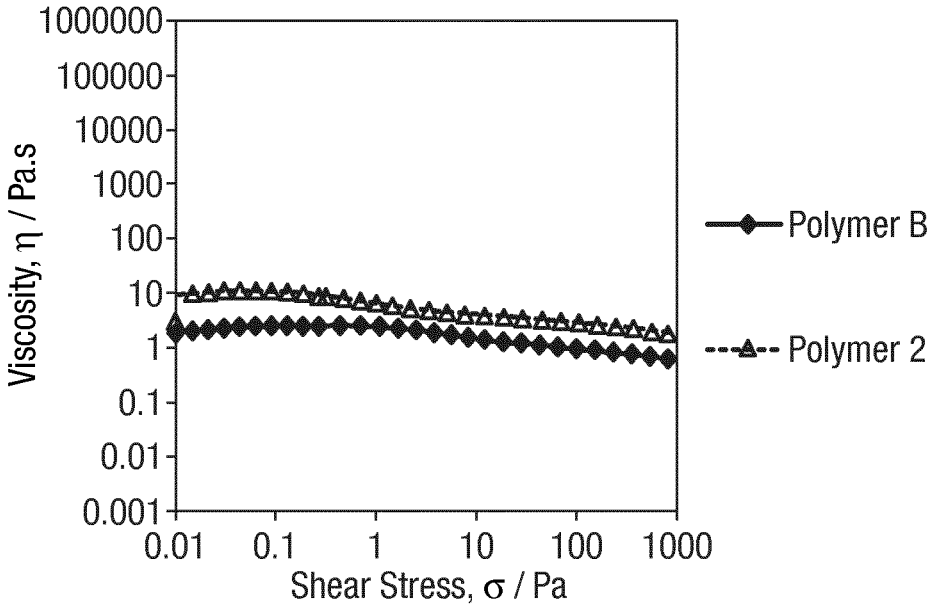
FIG. 5 shows rheology curves for Polymers in a higher surfactant composition with thinning polymer.

FIG. 5: Copolymer 2 vs. Copolymer B in L4

Surfactant composition and ratio, as well as presence of EPEI, has an impact on the rheology of the formulations. Liquids comprising LAS and SLES are structured well at surfactant levels below 20 wt % and liquids comprising higher surfactant levels, especially those comprising APG may be structured at higher levels. Further detergent liquids comprising the copolymers are given in Table 3.

TABLE 3

Full Detergent compositions

| Composition | A | B | C | D | E | F |
|---|---|---|---|---|---|---|
| TOTAL active | 20.7 | 10.5 | 16.3 | 21.0 | 28.9 | 30 |
| Water | 58.8 | 75.4 | 55.6 | 73.0 | 58.5 | 53.98 |
| LAS acid | 7.8 | 3.3 | 4.9 | 8.4 | 9.2 | |
| SLES 3EO | 2.9 | 1.7 | 2.4 | 10.5 | 4.6 | |
| Amphoteric surfactant | | 0.5 | 0.9 | | | |
| NI 7EO | 5.5 | 5.0 | 7.3 | 2.1 | 14 | |
| APG | | | | | | 30.0 |
| Fatty acid | 4.5 | | 0.9 | | 1.5 | |
| Alkaline Neutraliser | 8.3 | 2.4 | 3.5 | 1.9 | 2.9 | 4.0 |
| Glycerol | 7.5 | | | | 5 | |
| MPG | | 8.0 | 14.0 | 2.0 | 2 | |
| Sequestrant | 3.6 | 0.9 | 1.5 | 0.5 | 0.3 | |
| Salt | | | | 0.5 | | |
| Copolymer thickener* | 0.3 | 0.5 | 1.5 | 0.25 | 0.2 | 1.75 |
| Perfume encapsulates | 1 | 0.5 | 2 | 1 | 1 | |
| EPEI | | 1.8 | 3.0 | | | |
| Soil release polymer | 0.1 | 0.8 | 2.1 | | | |
| Foam boosting polymer | | | | | | 10.0 |
| Enzymes | 0.0 | 0.0 | 2.2 | 0.4 | 0.8 | |
| Perfume, colorant and minors | 0.9 | 0.3 | 1.8 | 0.7 | 1.6 | 0.27 |

NB - above inclusion levels are all as 100% active

All compositions are alkaline

*Copolymer thickener is Copolymer 2.

The invention claimed is:

1. An aqueous polymer structured detergent liquid composition comprising:

(i) a surfactant system comprising surfactant and alkaline material present as surfactant salts and/or as free base, (ii) 0.001 wt % or more suspended particles, (iii) 3 wt % or more polymer that reduces the composition viscosity at 20 $s^{-1}$, and (iv) at least 0.05 wt % of a suspending system comprising copolymer formed by the addition polymerisation of:

(A) 0.1 to 5 wt % of a first monomer consisting of an ethylenically unsaturated diacid of formula (I):

$$HOOC—CR_1{=}CR_2—COOH \quad (I)$$

or an unsaturated cyclic anhydride precursor of such an ethylenically unsaturated diacid, the anhydride having formula (II)

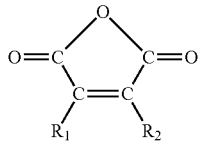

(II)

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of $C_1$-$C_8$ alkyl ester of (meth) acrylic acid;

(D) 1 to 25 wt %, of a fourth ethylenically unsaturated monomer, consisting of surfmer of formula (III):

$$R_3—C{=}C(R_4)—T—[CH_2]_k—[O]_m—[R_6O]_n—Y—R_7 \quad (III)$$

wherein each $R_3$ and $R_4$ are each independently selected from H, methyl, —C(=O)OH, or —C(=O)$OR_5$;

$R_5$ is a $C_1$-$C_{30}$ alkyl;

T is —$CH_2$C(=O)O—, —C(=O)O—, —O—, —$CH_2$O—, —NHC(=O)NH—, —C(=O)NH—, —Ar—$(CE_2)_z$-NHC(=O)O—, —Ar—$(CE_2)_z$-NHC(=O)NH—, or —$CH_2CH_2$NHC(=O)—;

Ar is divalent aryl;

E is H or methyl;

z is 0 or 1;

k is an integer in the range of 0 to 30; and m is 0 or 1; with the proviso that when k is 0, m is 0, and when k is in the range of 1 to 30; m is 1;

$(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(=O)—, —C(=O)NH—, =$R_6$NHC(=O)NH—, or —C(=O)NHC(=O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen; and (E) 0.005 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof.

2. A composition according to claim 1 wherein the viscosity of the liquid at 20 $s^{-1}$ and 25° C. is at least 0.3 Pa·s.

3. A composition according to claim 1 having a yield stress of at least 0.1 Pa.

4. A composition according to claim 3 wherein the suspended particles comprise microcapsules.

5. A composition according to claim 4 wherein the microcapsules comprise perfume encapsulates.

6. A composition according to claim 1 wherein the suspended particles comprise beads or lamellar particles formed from sheets of polymer film.

7. A composition according to claim 1 comprising at least 0.1 wt % of the copolymer (iv).

8. A composition according to claim 1 wherein viscosity reducing polymer (iii) comprises ethoxylated polyethylene imine.

9. A composition according to claim 1 wherein viscosity reducing polymer (iii) comprises polyester soil release polymer.

10. A composition according to claim 1 wherein the copolymer (iv) has a molecular weight Mw of at least 500,000 Daltons.

11. A composition according to claim 1 wherein the first monomer A in copolymer (iv) is maleic anhydride.

12. A composition according to claim 1 wherein the Surfmer D in copolymer (iv) has the formula (IV)

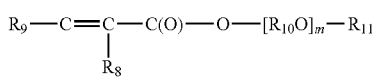

(IV)

where:

$R_8$ and $R_9$ are each independently selected from H, and $C_{1-3}$ alkyl;

$R_{10}$ is $C_2$-$C_4$ and mixtures thereof;

m, the average number of alkoxy units $R_{10}O$, is from 6 to 40;

$R_{11}$ is alkyl or alkylaryl where the alkyl part is linear or branched; and the total number of carbons is from 10 to 40.

13. A composition according to claim 1 wherein the Surfmer D in copolymer (iv) has the formula (V):

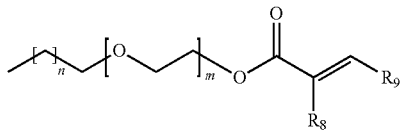

(V)

wherein each $R_8$ and $R_9$ are independently selected from H, $C_1$ to $C_3$ alkyl, n ranges from 6 to 40 and m ranges from 6 to 40.

14. A composition according to claim 1 wherein the surfactant system comprises at least 5 wt % total surfactant.

15. A composition according to claim 1 wherein the surfactant system comprises at least 3 wt % anionic surfactant.

16. A composition according to claim 1 which comprises alkyl benzene sulphonate anionic surfactant.

17. A composition according to claim 1, comprising 0.01% or more suspended particles.

18. A composition according to claim 2 wherein the viscosity of the liquid at 20 $s^{-1}$ and 25° C. is at least 0.4 Pa·s.

19. A composition according to claim 12 wherein $R_{10}$ is $C_2$.

20. A composition according to claim 13 wherein $R_8$ is a methyl group, $R_9$ is H, n ranges from 10 to 30 and m ranges 15 to 35.

21. A composition according to claim 20 wherein n ranges from 12 to 22 and m ranges from 20 to 30.

22. A composition according to claim 1 wherein the alkaline material comprises an amine oxide.

23. The composition according to claim 22 wherein the amine oxide has the formula:

$$R^1N(O)(CH_2R^2)_2$$

wherein $R^1$ is a hydrocarbyl moiety having a chain length of from 8 to 18 and $R^2$ is selected from hydrogen, methyl, and —$CH_2OH$.

24. An aqueous polymer structured detergent liquid composition comprising:

(i) a surfactant system comprising surfactant and alkaline material present as surfactant salts and/or as free base, (ii) 0.001 wt % or more suspended particles, and (iii) at least 0.05 wt % of a suspending system comprising copolymer formed by the addition polymerisation of:

(A) 0.1 to 5 wt % of a first monomer consisting of an ethylenically unsaturated diacid of formula (I):

$$HOOC—CR_1{=}CR_2—COOH \quad (I)$$

or an unsaturated cyclic anhydride precursor of such an ethylenically unsaturated diacid, the anhydride having formula (II)

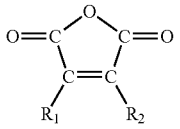

(II)

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of $C_1$-$C_8$ alkyl ester of (meth) acrylic acid;

(D) 1 to 25 wt %, of a fourth ethylenically unsaturated monomer, consisting of surfmer of formula (III):

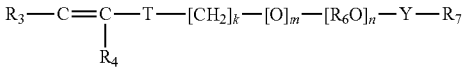

(III)

wherein each $R_3$ and $R_4$ are each independently selected from H, methyl, —C(=O)OH, or —C(=O)$OR_5$;

$R_5$ is a $C_1$-$C_{30}$ alkyl;

T is —$CH_2$C(=O)O—, —C(=O)O—, —O—, —$CH_2$O—, —NHC(=O)NH—, —C(=O)NH—,

—Ar—$(CE_2)_z$-NHC(=O)O—, —Ar—$(CE_2)_z$-NHC(=O)NH—, or —$CH_2CH_2$NHC(=O)—;

Ar is divalent aryl;

E is H or methyl;

z is 0 or 1;

k is an integer in the range of 0 to 30; and m is 0 or 1; with the proviso that when k is 0, m is 0, and when k is in the range of 1 to 30; m is 1;

$(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(=O)—, —C(=O)NH—, =$R_6$NHC(=O)NH—, or —C(=O)NHC(=O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen; and (E) 0.005 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof.

25. The composition according to claim 24 further comprising 3 wt % or more polymer that reduces the composition viscosity at 20 $s^{-1}$.

26. An aqueous polymer structured detergent liquid composition comprising:

(i) a surfactant system comprising surfactant and alkaline material present as surfactant salts and/or as free base, (ii) an amine oxide, and (iii) at least 0.05 wt % of a suspending system comprising copolymer formed by the addition polymerisation of:

(A) 0.1 to 5 wt % of a first monomer consisting of an ethylenically unsaturated diacid of formula (I):

$$HOOC—CR_1=CR_2—COOH \quad (I)$$

or an unsaturated cyclic anhydride precursor of such an ethylenically unsaturated diacid, the anhydride having formula (II)

(II)

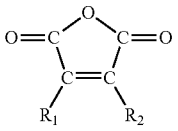

where $R_1$ and $R_2$ are individually selected from H, $C_1$-$C_3$ alkyl, phenyl, chlorine and bromine;

(B) 15 to 60 wt % of a second ethylenically unsaturated monoacidic monomer consisting of (meth)acrylic acid;

(C) 30 to 70 wt % of a third ethylenically unsaturated monomer consisting of $C_1$-$C_8$ alkyl ester of (meth) acrylic acid;

(D) 1 to 25 wt %, of a fourth ethylenically unsaturated monomer, consisting of surfmer of formula (III):

$$R_3—C=C(R_4)—T—[CH_2]_k—[O]_m—[R_6O]_n—Y—R_7 \quad (III)$$

wherein each $R_3$ and $R_4$ are each independently selected from H, methyl, —C(=O)OH, or —C(=O)$OR_5$;

$R_5$ is a $C_1$-$C_{30}$ alkyl;

T is —$CH_2$C(=O)O—, —C(=O)O—, —O—, —$CH_2$O—, —NHC(=O)NH—, —C(=O)NH, —Ar—$(CE_2)_z$-NHC(=O)O—, —Ar—$(CE_2)_z$-NHC(=O)NH—, or —$CH_2CH_2$NHC(=O)—;

Ar is divalent aryl;

E is H or methyl;

z is 0 or 1;

k is an integer in the range of 0 to 30; and m is 0 or 1; with the proviso that when k is 0, m is 0, and when k is in the range of 1 to 30; m is 1;

$(R_6O)_n$ is polyoxyalkylene, which is a homopolymer, a random copolymer, or a block copolymer of $C_2$-$C_4$-oxyalkylene units, wherein $R_6$ is $C_2H_4$, $C_3H_6$, $C_4H_8$, or a mixture thereof, and n is an integer in the range of 5 to 250; Y is —$R_6$O—, —$R_6$—, —C(=O)—, —C(=O)NH—, =$R_6$NHC(=O)NH—, or —C(=O)NHC(=O)—; and $R_7$ is substituted or unsubstituted alkyl selected from the group consisting of $C_8$-$C_{40}$ linear alkyl, $C_8$-$C_{40}$ branched alkyl, $C_8$-$C_{40}$ carbocyclic alkyl, $C_2$-$C_{40}$ alkyl-substituted, phenyl, aryl-substituted $C_2$-$C_{40}$ alkyl, and $C_8$-$C_{80}$ complex ester; wherein the $R_7$ alkyl group optionally comprises one or more substituents selected from the group consisting of hydroxy, alkoxy, and halogen; and (E) 0.005 to 5 wt %, of a cross linking agent, for introducing branching and controlling molecular weight, the cross linking monomer comprising polyfunctional units carrying multiple reactive functionalisation groups selected from the group consisting of vinyl, allyl and functional mixtures thereof.

27. The composition according to claim 26 wherein the amine oxide has the formula:

$$R^1N(O)(CH_2R^2)_2$$

wherein $R^1$ is a hydrocarbyl moiety having a chain length of from 8 to 18 and $R^2$ is selected from hydrogen, methyl, and —$CH_2$OH.

* * * * *